United States Patent [19]

Byczek et al.

[11] Patent Number: 4,561,714

[45] Date of Patent: Dec. 31, 1985

[54] CONTACT ASSEMBLY FOR RIBBON CABLE

[75] Inventors: Roger W. Byczek, Westchester; Norman R. Wurz, Norridge, both of Ill.

[73] Assignee: Bally Midway Mfg. Co., Chicago, Ill.

[21] Appl. No.: 559,237

[22] Filed: Dec. 8, 1983

[51] Int. Cl.[4] ..... H01R 13/39

[52] U.S. Cl. ..... 339/97 P; 339/258 P

[58] Field of Search ..... 339/97 R, 97 C, 97 P, 339/99 R, 258 R, 258 P

[56] References Cited

U.S. PATENT DOCUMENTS

| | | | |
|---|---|---|---|
| 3,853,389 | 12/1974 | Occhipinte | 339/258 R |
| 4,243,288 | 1/1981 | Lucius et al. | 339/99 R |
| 4,371,225 | 2/1983 | Narozny | 339/97 C |

FOREIGN PATENT DOCUMENTS

| | | | |
|---|---|---|---|
| 7505547 | 9/1976 | France | 339/258 R |

*Primary Examiner*—Joseph H. McGlynn

*Attorney, Agent, or Firm*—Jenner & Block

[57] ABSTRACT

An electrical cable assembly includes a plurality of spaced strip conductors within a supporting body of dielectric material with a contact element for each conductor, all of which are supported in a single housing. Each contact element includes a penetrating end having a plurality of tangs for piercing the dielectric material and a contact mating end, which includes a tubular body having a plurality of deflectable fingers that have free ends adjacent the penetrating end of the contact element.

6 Claims, 7 Drawing Figures

CONTACT ASSEMBLY FOR RIBBON CABLE

DESCRIPTION

1. Technical Field

The present invention relates generally to electrical connectors and, more particularly, to connectors for use with flat, flexible cables.

2. Background Prior Art

Flat, flexible cables now on the market commonly comprise a plurality of transversely-spaced copper or other metal conductors embedded within a flexible insulating jacket of dielectric material, such as various forms of polyester, polyethylene, polyvinyl or silicon rubber.

To make contact with the conductors embedded into the dielectric material, it has been customary to remove a portion of the insulation to expose the conductors. It has been found that removal of the portion of insulating cable of this type is a tedious, uncertain and generally difficult undertaking because the conductors are very thin. It is possible that the conductor may be severed during removal of the insulation. Ribbon cable of this type have many conductors in a single sheet and there may be more than twenty such conductors in a single flexible cable.

Various types of contacts have been proposed which eliminate the need for removing the dielectric material and examples are disclosed in U.S. Pat. No. 3,189,863 and No. 3,355,699.

Recently, companies have begun marketing contact connectors for ribbon cable having a plurality of conductors in a single cable.

While there are a number of different types of contact elements designed for use with ribbon cable, manufacturers are constantly striving to produce a better contact element at a cheaper price.

SUMMARY OF THE INVENTION

According to the present invention, a contact element has been developed which can easily be attached to a conductor in a ribbon cable through multiple contacts and which will have a relatively low force required for insertion of a mating pin, and will have high contact pressure after insertion of the mating pin.

The contact element of the present invention includes an elongated conductive member that has a penetrating end and a contact mating end. The penetrating end consists of a generally flat body having a plurality of tangs extending from opposed edges for penetrating the dielectrical material of the cable and making electrical contact with a conductor within the dielectrical material. The plurality of tangs make multiple-point contact with the conductor, which allows each piercing member to be relatively thin to provide a clean cut through the dielectrical material.

The contact mating end of the contact element consists of a generally tubular body that defines an elongated opening for receipt of a mating pin. The tubular body has a plurality of fingers deformed therefrom which extend from the open end of the body towards the penetrating end of the contact element. All of the contact elements are enclosed in a single housing of dielectrical material.

The resultant structure provides a low initial insertion force for the mating pin which progressively increases as the mating pin is further inserted into the opening. In the fully-inserted position, the particular configuration of the contact fingers results in high contact pressure between the mating pin and the contact element.

BRIEF DESCRIPTION OF SEVERAL VIEWS OF DRAWINGS

DETAILED DESCRIPTION

Figure 1:
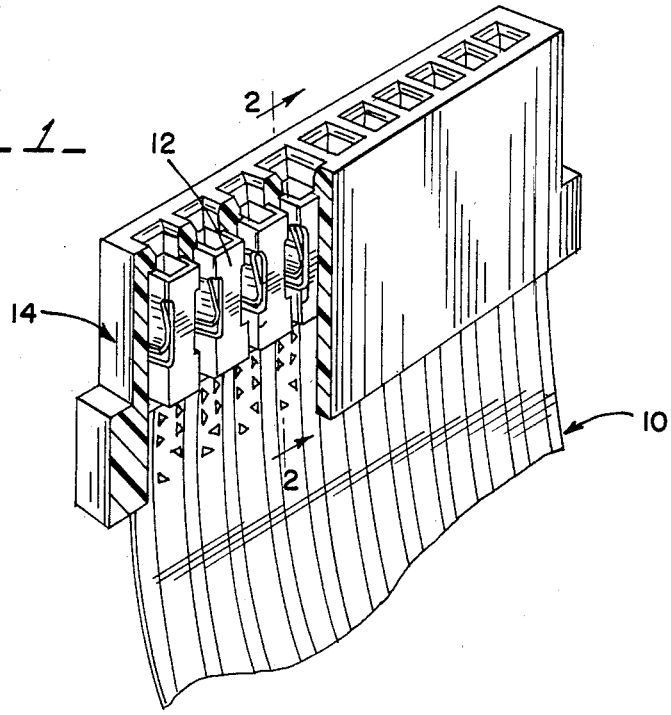
FIG. 1 is a perspective view with parts broken away of an electrical cable assembly having the contact elements of the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
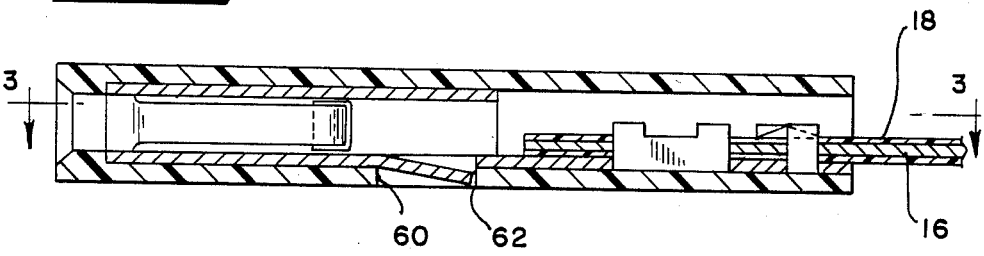
FIG. 2 is an enlarged cross-sectional view, as viewed along line 2—2 of FIG. 1.

FIG. 1 of the drawings shows an electrical cable assembly incorporating the features of the present invention associated with an elongated ribbon cable conductor, generally designated by reference numeral 10, a plurality of contact elements 12 and a dielectric housing 14 for the contact elements. The ribbon cable 10 has a plurality of tubular or flat conductors 16 that are enclosed in a dielectric material 18 (FIG. 2).

Figure 5:
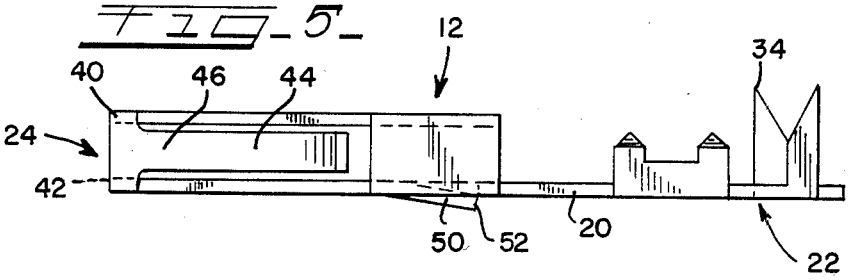
FIG. 5 is a side elevation view of the contact element of the present invention.
Figure 6:
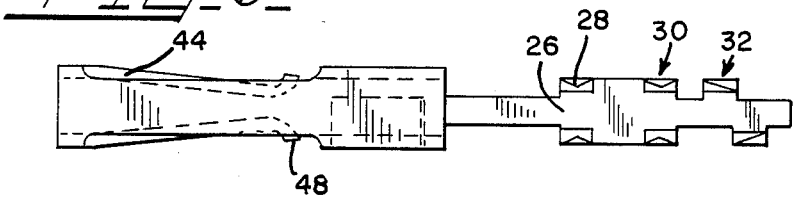
FIG. 6 is a top view of the contact element.
Figure 7:
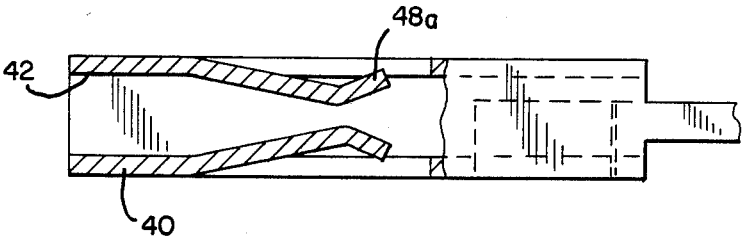
FIG. 7 is a fragmentary, cross-sectional view showing a slightly modified form of contact element.

The details of the contact elements 12 are shown in FIGS. 5, 6 and 7 and consists of an elongated conductive metal member 20 that has a penetrating or first end 22 and a mating contact or second end 24. The penetrating end 22 consists of a generally elongated flat rectangular body member 26 having a plurality of pairs of tangs 28, 30 and 32 extending from opposite lateral edges thereof. It will be noted that the pair of piercing tangs 32 are of slightly greater length than the pairs of piercing tangs 28 and 30. The pair of piercing tangs are axially offset from each other and each tang has a sharp point 34. Utilization of six such tangs allows the manufacturer to reduce the thickness of the tangs, which can then pierce entirely through the metal conductor and be crimped on the opposite side of the dielectrical material, as will be explained below.

The mating contact portion 24 of the contact element 12 consists of a generally tubular body 40 that has an elongated opening 42 defined therein which is open at both ends. In the illustrated embodiment, the opening 42 is rectangular, but the opening could easily be made circular, if desired.

The tubular body also has a plurality of resilient fingers 44 forming a part thereof. It will be noted that the fingers 44, a pair being shown for illustration purposes, have integral ends 46 adjacent the outer open end 47 of opening 42 and extend inwardly towards the penetrating end of the contact element. The inner free ends of the contact fingers 44 have angularly-related end portions 48, for a purpose that will be described later.

The tubular body also has a locking tab 50 deformed therefrom which has a free edge 52 that defines a locking edge which engages an edge 62 of an opening 60 (FIG. 2) in housing 14, as will be described later.

Figure 3:
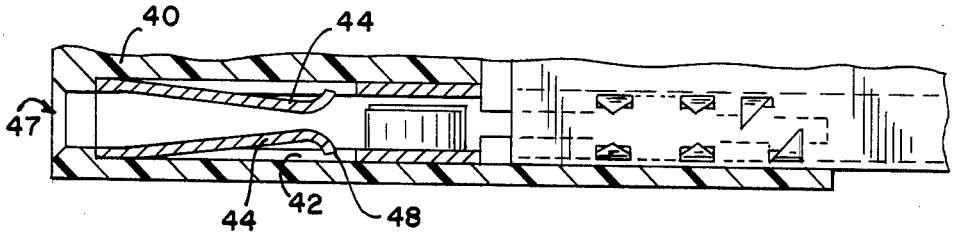
FIG. 3 is a cross-sectional view, as viewed along line 3—3 of FIG. 2.
Figure 4:
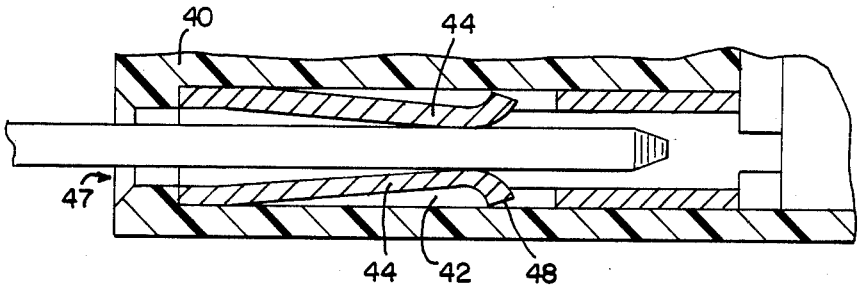
FIG. 4 is an enlarged cross-sectional view of the mating contact end of the cable assembly.

In assembly of the cable assembly, a contact element is generally aligned with the end of the ribbon cable in overlapping relation, with a conductor 16 therein and all of the contact elements are then simultaneously attached thereto by having the piercing elements 28, 30 and 32 pierce directly through the dielectric material and the metal conductor and then be crimped over at the opposite side, as clearly illustrated in FIGS. 2 and 3. After all of the contact elements 12 have been attached to respective conductors, the housing 14 is telescoped over all of the contact elements simultaneously. As the housing is telescoped over the respective contact elements, the tab 50 is deflected inwardly until such time that it is aligned with the opening 60 where it will deflect outwardly and lock the contact element within the housing.

The contact element of the present invention has numerous advantages over the prior art-type of devices in assembly and in actual use. For example, having the contact fingers or beams directed inwardly from the outer open end of the tubular body will result in the insertion force for inserting a mating pin being initially relatively light or low, thereby allowing for ease of alignment of the mating pin with the opening. As the mating pin is further inserted into the opening, it engages the inner surfaces of the contact fingers 44 and causes the contact fingers to be forced outwardly away from each other. If the mating pin is sufficiently large, the free ends of the angularly-related portions 48 may engage the inner surface of the dielectric housing and may be deflected between opposite ends thereof to thereby provide increased contact pressure and adequate wiping action of the mating pin with the surface of the contact.

The contact element is designed to be used with circular or rectangular mating pins of different lengths and cross-sectional sizes.

Also, the use of a plurality of tangs allows for the use of thinner metal resulting in better penetrating action.

Various modifications come to mind without departing from the spirit of the invention. For example, angularly-related end portions 48 could be flat, as illustrated at 48*a* in FIG. 7.

The fingers 44 need not be of equal length and more than one set of fingers could be provided to accomodate mating pins of different lengths. Also, the resilient fingers need not be formed in opposing pairs.

Of course, numerous modifications come to mind without departing from the spirit of the invention.

We claim:

1. An electrical cable assembly comprising, in combination, an electrical cable including a plurality of transversely-spaced, elongated strip conductors within a supporting body of flexible dielectric material, a contact element for each of said conductors and a non-conductive housing having locking ledges, and interior housing walls to separate adjacent contact elements, the walls together enclosing all of said contact elements, the improvement wherein each contact element includes a penetrating end and a contact end, said penetrating end having a generally flat body and a plurality of tangs extending directly from opposite edges of said generally flat body and of sufficient length to penetrate the dielectric material and a conductor, thus making electrical and mechancial contact with a single conductor, and to be crimped over without making contact with the tang projecting from the opposite side, said contact end including a tubular body defining an elongated opening for receipt of a mating pin, a locking tab deformed from the tubular body, the tab being deflected inwardly during insertion of the tubular body into the housing and then deflecting outwardly to lock into the housing locking ledges when the tubular body has been completely inserted into the housing, a plurality of resilient deflectable contact fingers deformed from said tubular body and integral with said tubular body adjacent its free end and extending inwardly toward said penetrating end so that the fingers have portions normally located in said elongated opening and moved out of said opening when said mating pin is inserted therein, the contact fingers further having outwardly turned distal end portions on the free end thereof being directed outward a distance greater than the thickness of the contact finger toward the housing wall to make contact between the free end of the contact finger and the housing wall such that upon insertion of a mating pin the fingers are deflected intermediate opposite ends to increase the contact force on the mating pin.

2. An electrical cable assembly as defined in claim 1, in which said elongated opening is rectangular in cross-section.

3. An electrical cable assembly as defined in claim 1, in which said locking tab is deformed from said tubular member at the tubular member end nearest said penetrating member beyond the tubular member portion reached by said free ends of the contact fingers.

4. A contact element for use with a non-conducting housing having walls enclosing all of the contact elements, the contact element comprising an elongated conductive metal member having first and second portions adjacent first and second ends, the first portion including an elongated, generally flat body having a plurality of tangs extending substantially perpendicularly and directly from opposite edges thereof, the second portion being formed to produce a tubular body defining an elongated socket opening for receiving a male pin and a pair of opposed elongated, deflectable contact fingers deformed from the tubular body and integral at one end with the tubular body and having opposite ends free and extending into the socket opening and directed towards the first portion, and further the free ends having outwardly turned distal end portions directed away from the socket opening a distance greater than the thickness of the contact fingers such that the outwardly turned distal end portions make contact with the enclosing housing walls such that upon insertion of a mating pin the fingers are deflected intermediate opposite ends to increase the contact force on the mating pin.

5. A contact element as defined in claim 4, in which said socket opening is rectangular in cross-section.

6. An electrical connection for an electrical cable including a plurality of spaced-apart strip conductors within a supporting body of flexible dielectric material and a non-conductive housing having interior walls to enclose the connection, comprising a contact element formed of conductive metal having a first end and a second end, said first end having a generally flat portion with a plurality of tangs extending substantially perpendicularly to said flat portion and of sufficient length for penetrating through the dielectric material and a conductor to make mechanical and electrical contact with the conductor, and to be crimped over without contacting the tang projecting from the opposite side, said second end having a socket defining an elongated opening and first and second flexible conductive members being oppositely related and directed inward to the elongated opening and having outwardly turned distal free ends adjacent said first end, the outwardly turned distal ends of the conductive members making contact with the enclosing housing walls, said elongated opening adapted to receive a mating pin with said pin initially forcing said first and second conductive members out of said opening until the conductive members become restrained by the outwardly turned distal end contact with the housing wall, such that the contact members are deflected intermediate opposite ends to gradually increase the contact force on the mating pin.

* * * * *